US011421716B2

(12) United States Patent
Takakuwa et al.

(10) Patent No.: US 11,421,716 B2
(45) Date of Patent: Aug. 23, 2022

(54) GAS CYLINDER

(71) Applicant: SMC CORPORATION, Tokyo (JP)

(72) Inventors: Youji Takakuwa, Kitakatsushika-gun (JP); Naoki Shinjo, Nagareyama (JP); Akihiro Kazama, Moriya (JP)

(73) Assignee: SMC CORPORATION, Tokyo (JP)

( * ) Notice: Subject to any disclaimer, the term of this patent is extended or adjusted under 35 U.S.C. 154(b) by 0 days.

(21) Appl. No.: 17/341,455

(22) Filed: Jun. 8, 2021

(65) Prior Publication Data

US 2021/0388855 A1 Dec. 16, 2021

(30) Foreign Application Priority Data

Jun. 10, 2020 (JP) ..... JP2020-101040

(51) Int. Cl.

| | |
|---|---|
| ***F15B 15/22*** | (2006.01) |
| *F15B 15/14* | (2006.01) |
| *F15B 15/24* | (2006.01) |
| *F15B 15/20* | (2006.01) |

(52) U.S. Cl.

CPC ..... *F15B 15/22* (2013.01); *F15B 15/222* (2013.01); *F15B 15/149* (2013.01); *F15B 15/1423* (2013.01); *F15B 15/1428* (2013.01); *F15B 15/1433* (2013.01); *F15B 15/1457* (2013.01); *F15B 15/204* (2013.01); *F15B 15/24* (2013.01)

(58) Field of Classification Search

CPC ..... F15B 15/22; F15B 15/222; F15B 15/223; F15B 15/1423; F15B 15/1428; F15B 15/1433; F15B 15/1457; F15B 15/15149; F15B 15/204; F15B 15/24

See application file for complete search history.

(56) References Cited

U.S. PATENT DOCUMENTS 3,224,817 A * 12/1965 Carter ..... F15B 15/1433 277/439
3,238,850 A * 3/1966 Desmarchelier ..... F15B 15/223 91/394
3,805,672 A * 4/1974 Pekrul ..... F15B 15/223 92/85 B
3,974,910 A * 8/1976 Papai ..... F15B 15/222 91/394

(Continued)

FOREIGN PATENT DOCUMENTS

JP 61-141804 U 9/1986
JP 63-008405 U 1/1988

(Continued)

*Primary Examiner* — Dustin T Nguyen

(74) *Attorney, Agent, or Firm* — Oblon, McClelland, Maier & Neustadt, L.L.P.

(57) ABSTRACT

A gas cylinder includes supply passages for supplying, to an accommodation chamber, a part of gas supplied to a second port. When the pressure in a first pressure chamber is equal to or lower than a prescribed pressure, a valve element closes a discharge flow passage by the biasing force of a spring member and the pressure in the accommodation chamber. When the pressure in the first pressure chamber exceeds the prescribed pressure, the valve element is moved by the pressure in the first pressure chamber, against the biasing force and the pressure in the accommodation chamber, to thereby open the discharge flow passage.

10 Claims, 11 Drawing Sheets

(56) References Cited

U.S. PATENT DOCUMENTS

| | | | | | |
|---|---|---|---|---|---|
| 4,088,061 | A * | 5/1978 | Stoll | F15B 15/223 | 277/552 |
| 5,307,729 | A * | 5/1994 | Hedlund | F15B 15/22 | 91/394 |
| 6,038,956 | A * | 3/2000 | Lane | F15B 15/222 | 91/409 |
| 7,021,192 | B2 * | 4/2006 | Kita | F15B 15/223 | 91/394 |
| 7,581,485 | B2 * | 9/2009 | Riedel | F15B 15/222 | 91/395 |
| 8,596,431 | B2 * | 12/2013 | Bruder | F15B 15/223 | 91/394 |
| 2003/0070541 | A1 * | 4/2003 | Migliori | F15B 15/223 | 92/85 B |

FOREIGN PATENT DOCUMENTS

| | | | |
|---|---|---|---|
| JP | 06-341411 | A | 12/1994 |
| JP | 3466121 | B2 | 11/2003 |

* cited by examiner

GAS CYLINDER

CROSS-REFERENCE TO RELATED APPLICATION

This application is based upon and claims the benefit of priority from Japanese Patent Application No. 2020-101040 filed on Jun. 10, 2020, the contents of which are incorporated herein by reference.

BACKGROUND OF THE INVENTION

Field of the Invention

The present invention relates to a gas cylinder with a cushioning mechanism that brakes the motion of a piston when the piston stops at a stroke end.

Description of the Related Art

Conventionally, providing cushioning mechanisms in order to alleviate the impact at the stroke end of the piston in a gas cylinder has been disclosed in JP S61-141804 U, JP S63-008405 U, JP H06-341411 A, and JP 3466121 B2. These documents disclose configurations in which a throttle valve is built in the cover of the gas cylinder, and the degree of opening of the throttle valve is manually adjusted in conformity with the gas cylinder's usage conditions such as the piston speed (cylinder speed), whereby the amount of gas discharged from the pressure chamber (cylinder chamber) between the stroke end and the piston is regulated.

SUMMARY OF THE INVENTION

Incidentally, when handling a production facility having multiple gas cylinders of the same structure installed, it is necessary to manually adjust the throttle valve for each of the gas cylinders, which increases the burden on the person in charge.

In addition, manual adjustment of the throttle valve relies on the tactile perception of the person in charge. Moreover, since the degree of opening of the throttle valve is manually adjusted by a screw type adjusting mechanism, daily maintenance such as checking for looseness of the screw due to vibration of the production facility or the like is required. As a result, repeated manual adjustment is needed.

Furthermore, when the cylinder speed is of high-speed specification, the cylinder speed on the stroke end side can be reduced by manually adjusting the opening of the throttle valve to reduce the discharged amount of gas. However, when the discharged amount of gas is reduced, the pressure in the cushioning chamber is greatly compressed and rises sharply, causing a bouncing phenomenon in which the piston is pushed back in the direction opposite to the advancing direction. As a result, the cycle time becomes longer and losses occur in the production facility.

To deal with this problem, provision of a configuration including: an orifice portion through which gas is discharged from the cushioning chamber; a discharge flow passage through which gas in the cushioning chamber is discharged in cooperation with the orifice portion; a valve element that opens or closes the discharge flow passage; and an elastic element that biases the proximal end of the valve element to move the valve element so as to close the discharge flow passage with the tip of the valve element, can be considered.

In this configuration, when the pressure in the cushioning chamber is equal to or lower than a prescribed threshold (prescribed pressure), the valve element closes the discharge flow passage by the biasing force of the elastic element. Accordingly, the gas in the cushioning chamber is discharged only through the orifice portion.

Further, when the pressure in the cushioning chamber exceeds the prescribed pressure, the valve element is moved by the pressure against the biasing force so as to open the discharge flow passage. As a result, the gas in the cushioning chamber is discharged through the discharge flow passage as well as the orifice portion.

In this configuration, when the prescribed pressure, which is the threshold above which the valve element is moved, is constant, an elastic element exerting a prescribed biasing force may be provided in the gas cylinder. However, when it is necessary to adjust the prescribed pressure according to the specifications required by the user, it is necessary to prepare multiple elastic elements having different biasing forces beforehand, select an elastic element having an optimal biasing force suited to the specifications from among the multiple elastic elements, and set the selected elastic element. As a result, the adjustment work for changing the prescribed pressure is troublesome and costly.

The present invention has been devised in view of the above problem, and it is therefore an object of the invention to provide a gas cylinder that allows automatic adjustment of the threshold (prescribed pressure) for moving a valve element, is free from the necessity of manual adjustment of the valve element, and can realize smooth arrival of the piston at the stroke end and mitigation of the impact on the piston while suppressing the occurrence of a bouncing phenomenon.

The aspect of the present invention resides in a gas cylinder comprising: a cylinder tube having a cylinder chamber formed therein; a first cover configured to close one end of the cylinder tube; a second cover configured to close another end of the cylinder tube; a piston configured to partition the cylinder chamber into a first pressure chamber on a side of the first cover, and a second pressure chamber on a side of the second cover, and slide in the cylinder chamber; a piston rod connected to the piston; a first port through which gas is supplied to and discharged from the first pressure chamber; a second port through which gas is supplied to and discharged from the second pressure chamber; and a cushioning mechanism configured to brake a motion of the piston at least when the piston stops at a stroke end on the side of the first cover.

The cushioning mechanism includes a communication shutoff portion configured to shut off communication between the first pressure chamber and the first port when the piston approaches the stroke end, an orifice portion configured to discharge gas from the first pressure chamber, and a discharge flow rate regulator configured to discharge gas from the first pressure chamber in cooperation with the orifice portion.

The discharge flow rate regulator includes a discharge flow passage configured to discharge gas in the first pressure chamber, a valve element configured to open and close the discharge flow passage, an elastic element configured to close the discharge flow passage with a distal end of the valve element by biasing a proximal end of the valve element to move the valve element, and a gas storage portion.

The gas cylinder further includes a supply passage configured to supply, to the gas storage portion, a part of gas supplied to the second port. Here, when a pressure in the first pressure chamber is equal to or lower than a prescribed pressure that is based on a biasing force of the elastic element and a pressure in the gas storage portion, the valve element closes the discharge flow passage by the biasing force and the pressure in the gas storage portion. On the other hand, when the pressure in the first pressure chamber exceeds the prescribed pressure, the valve element is moved due to the pressure in the first pressure chamber, against the biasing force and the pressure in the gas storage portion, so as to open the discharge flow passage.

As already described, a bouncing phenomenon occurs when the pressure in the first pressure chamber (cushioning chamber) is greatly compressed and rises sharply as the piston moves toward the stroke end on the first cover side. That is, the bouncing phenomenon takes place when the balance between the thrust of the piston due to the pressure in the cushioning chamber and the thrust of the piston due to the pressure in the second pressure chamber is lost.

To deal with this, in the present invention, a part of the gas supplied from the second port to the second pressure chamber is supplied to the gas storage portion via the supply passage. This causes the prescribed pressure, which is the threshold for moving the valve element, to change depending on the pressure in the gas storage portion, that is, the pressure of the gas supplied from the second port to the second pressure chamber (the operating pressure of the piston). In other words, even when the biasing force of the elastic element is constant, the prescribed pressure varies according to the differential pressure between the pressure in the cushioning chamber and the pressure in the compression chamber.

In the above way, in the present invention, the prescribed pressure is adjusted by utilizing the pressure in the gas storage portion. As a result, if the elastic element having an optimum biasing force is installed in consideration of the differential pressure between the pressure in the first pressure chamber and the pressure in the second pressure chamber, it is possible to automatically adjust the prescribed pressure even when the pressure in the second pressure chamber changes. That is, it is not necessary to replace the elastic element to adjust the prescribed pressure.

In the present invention, when the pressure in the first pressure chamber is equal to or lower than the prescribed pressure, the distal end of the valve element closes the discharge flow passage by the effect of the biasing force from the elastic element and the pressure in the gas storage portion, so that the gas in the cushioning chamber is discharged only through the orifice portion. On the other hand, when the pressure in the first pressure chamber exceeds the prescribed pressure, the pressure causes the valve element to move, against the biasing force and the pressure in the gas storage portion and open the discharge flow passage, so that the gas in the first pressure chamber is discharged through the orifice portion and also through the discharge flow passage.

In this way, when the pressure in the first pressure chamber exceeds the prescribed pressure, the gas in the first pressure chamber is discharged through two routes. Thereby, the gas in the first pressure chamber is discharged in a short time, and the piston can reach the stroke end quickly and smoothly. As a result, the responsiveness of the gas cylinder can be improved while avoiding the occurrence of the bouncing phenomenon.

Further, as the valve element is moved due to the balance (differential pressure) between the biasing force of the elastic element and the pressure in the gas storage portion, and the pressure in the first pressure chamber, the state of the discharge flow passage is switched from open to closed or vice versa. This eliminates the need for manual adjustment of the valve element. As a result, when the discharge flow passage is in the open state, the degree of opening of the valve element can be gradually changed depending on the magnitude of the pressure in the first pressure chamber.

Therefore, in the present invention, it is possible to automatically adjust the prescribed pressure without the need for manual adjustment of the valve element, and also realize smooth arrival of the piston at the stroke end and alleviate the impact on the piston while suppressing the occurrence of the bouncing phenomenon.

The above and other objects, features, and advantages of the present invention will become more apparent from the following description when taken in conjunction with the accompanying drawings in which a preferred embodiment of the present invention is shown by way of illustrative example.

DESCRIPTION OF THE PREFERRED EMBODIMENTS

Next, a preferred embodiment of the gas cylinder according to the present invention will be illustrated and described with reference to the accompanying drawings.

1. Configuration of the Embodiment

Figure 1:
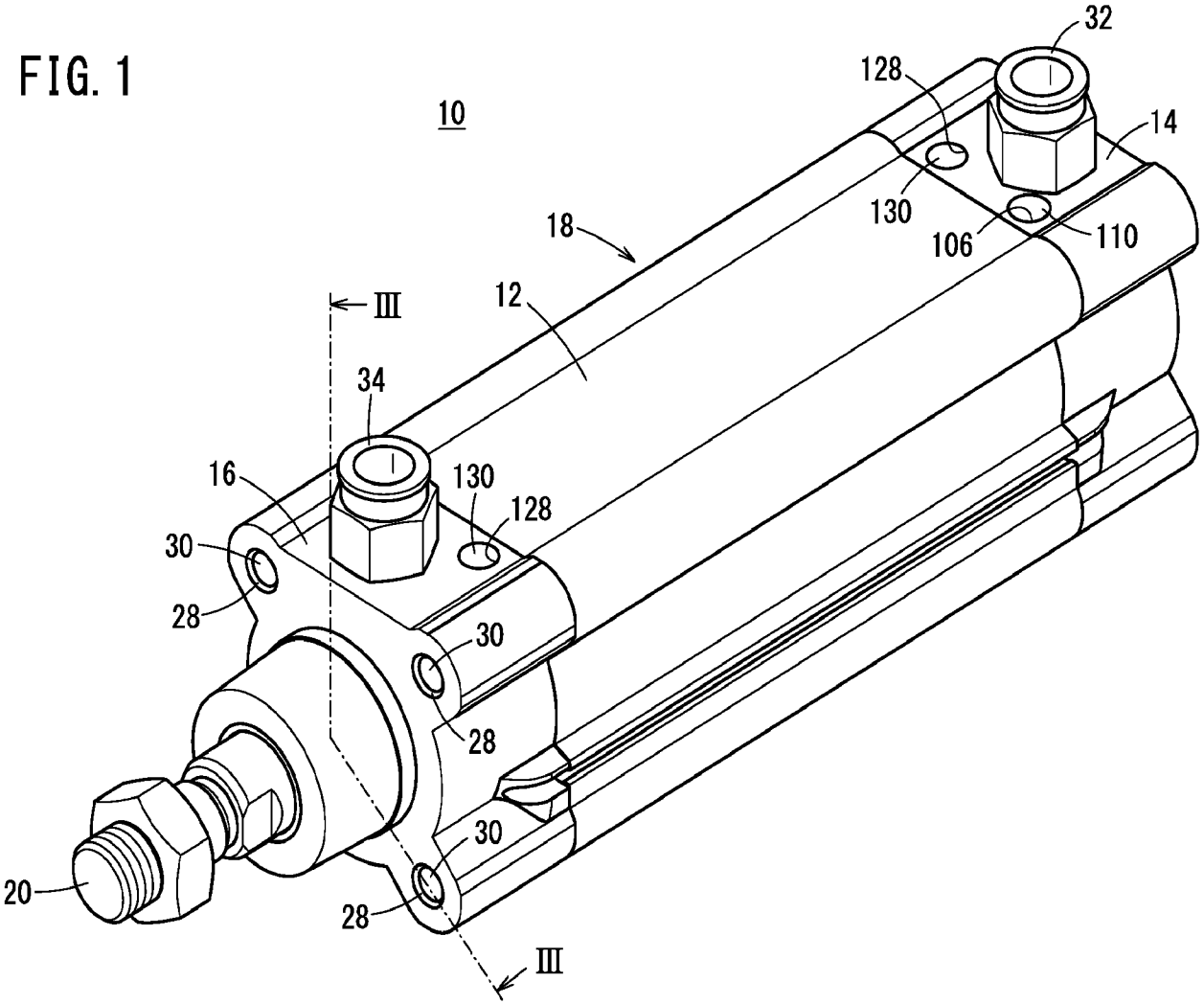
FIG. 1 is a perspective view of a gas cylinder according to the present embodiment.
Figure 2:
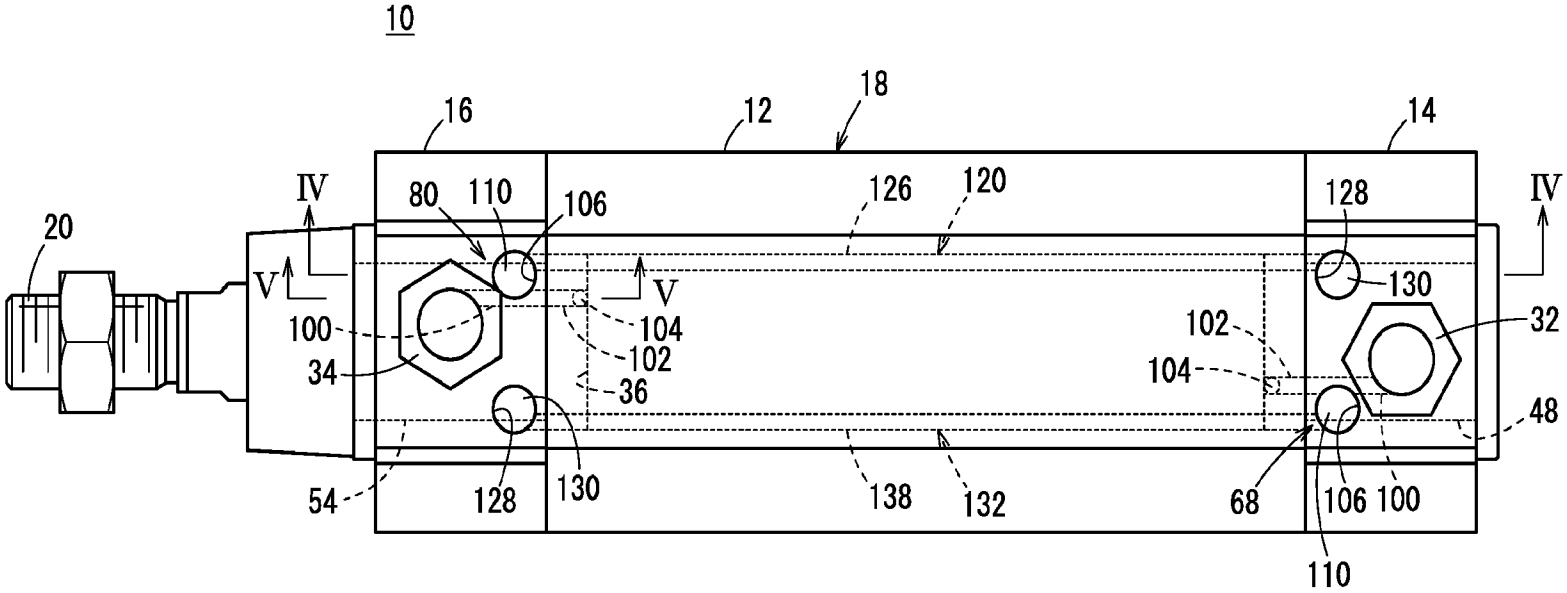
FIG. 2 is a plan view of the gas cylinder of FIG. 1.
Figure 3:
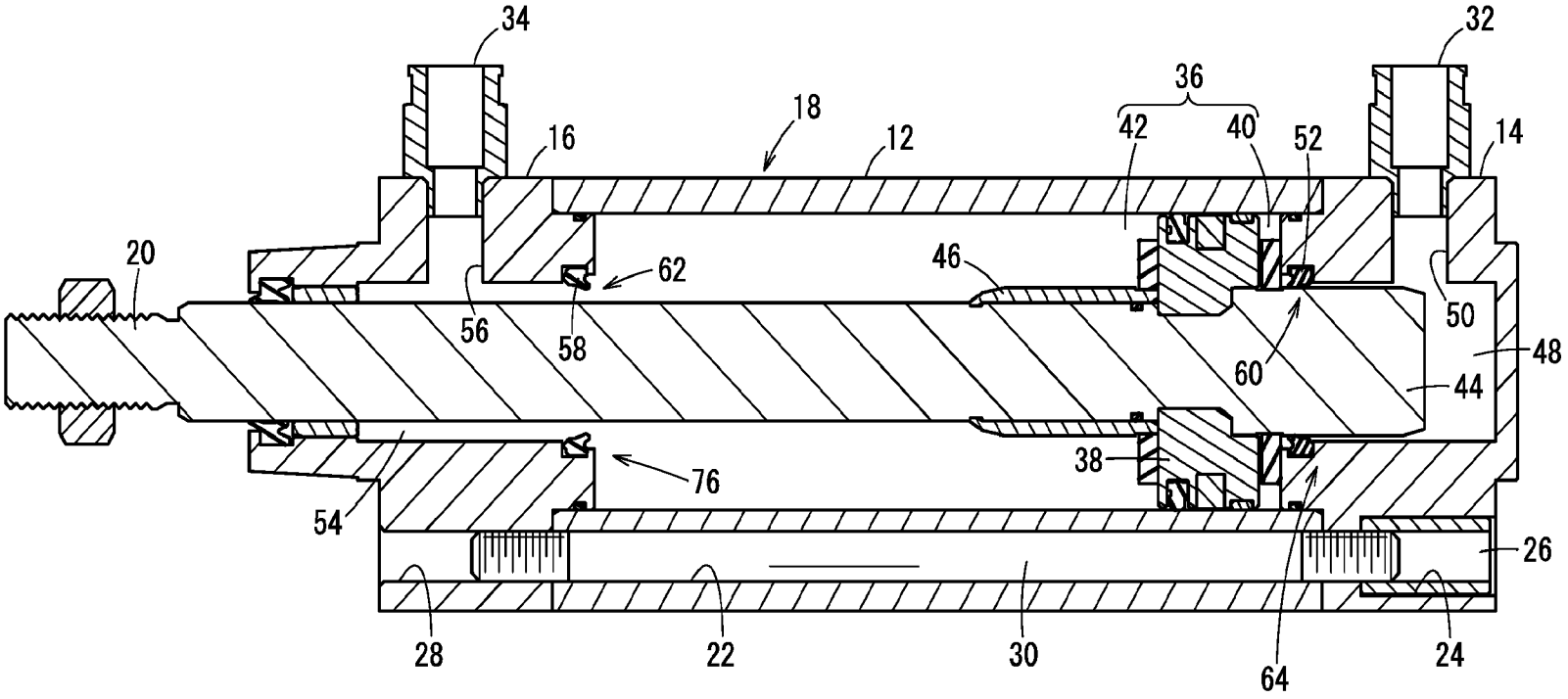
FIG. 3 is a sectional view taken along a line III-III in FIG. 1.

As shown in FIGS. 1 to 3, a gas cylinder 10 according to the present embodiment includes a cylindrical cylinder tube 12, a head cover 14 that seals (closes) one end of the cylinder tube 12, and a rod cover 16 that seals (closes) the other end of the cylinder tube 12. The cylinder tube 12, the head cover 14 and the rod cover 16 form a cylinder body 18 of the gas cylinder 10.

In appearance, the cylinder body 18 is formed in a rectangular parallelepiped shape longitudinally extending from the head cover 14 to the rod cover 16. The longitudinal direction is the extending direction of a piston rod 20, which will be described later, and is the axial direction of the gas cylinder 10. In the cylinder body 18, the four corners of the cross section orthogonal to the longitudinal direction (extending direction, axial direction) bulge outward.

A through hole 22 extending in the longitudinal direction is formed at each of the four corners of the cylinder tube 12

(see FIG. 3). Further, a stepped through hole 24 is formed at each of the four corners of the head cover tube 14 so as to be coaxial with the through hole 22. Each through hole 24 is formed of a small-diametric portion contiguous to the through hole 22 and a large-diametric portion contiguous to the small-diametric portion so as to be distant from the through hole 22. A tubular connecting member 26 threaded internally is fitted into the large-diametric portion of the through hole 24. Further, a threaded hole 28 is formed at each of the four corners of the rod cover 16 coaxially with the corresponding through hole 22.

A connecting rod 30 externally threaded at both ends is inserted in each through hole 22. The thread on one end side of each connecting rod 30 is screwed into the thread of each connecting member 26. Further, the thread on the other end side of each connecting rod 30 is screwed into the threaded hole 28. Therefore, the head cover 14 and the rod cover 16 are connected in the axial direction of the gas cylinder 10 by the multiple connecting rods 30, the multiple connecting members 26 on the head cover 14 side, and the multiple threaded holes 28 formed in the rod cover 16. Note that FIG. 3 illustrates a connected state of the connecting member 26, the threaded hole 28, and the connecting rod 30 at one corner, as a typical example.

As shown in FIGS. 1 to 3, a head-side port 32 is provided on the upper surface of the head cover 14. Further, as shown in FIGS. 1 to 7, a rod-side port 34 is provided on the upper surface of the rod cover 16. The piston rod 20 projects and extends from the rod cover 16.

A cylinder chamber 36 is formed inside the cylinder tube 12 (see FIGS. 3 to 8). In the cylinder chamber 36, a piston 38 that slides in the axial direction between the stroke start end (stroke end) on the head cover 14 side and the stroke terminal end (stroke end) on the rod cover 16 side is disposed. The piston 38 divides the cylinder chamber 36 into a head-side pressure chamber 40 on the head cover 14 side and a rod-side pressure chamber 42 on the rod cover 16 side.

The piston rod 20 is coupled with the piston 38 (see FIGS. 1 to 3 and 8). One end of the piston rod 20 is connected to the piston 38. The other end of the piston rod 20 penetrates through the rod cover 16 and projects to the outside. A head-side cushion pin 44 is connected to the head cover 14 side of the piston 38 (see FIG. 3). A rod-side cushion pin 46 is attached to the peripheral surface of the piston rod 20 on the rod cover 16 side of the piston 38.

The head cover 14 is formed with a depressed head cover chamber 48 into which the head-side cushion pin 44 is inserted when the piston 38 approaches the stroke start end. A through hole 50 that penetrates through the head cover 14 upward is formed on the interior side of the head cover chamber 48. The through hole 50 communicates with the head-side port 32. Therefore, the head-side port 32 supplies gas to, and discharges gas from, the head-side pressure chamber 40 through the through hole 50 and the head cover chamber 48. A cushioning packing 52 such as an O-ring, which comes into sliding contact with the head-side cushion pin 44 inserted into the head cover chamber 48, is provided on the piston 38 side of the head cover chamber 48.

The rod cover 16 is formed with a depressed rod cover chamber 54 into which the rod-side cushion pin 46 is fitted when the piston 38 approaches the stroke terminal end. A through hole 56 that penetrates through the rod cover 16 upward is formed on the interior side of the rod cover chamber 54. The through hole 56 communicates with the rod-side port 34. Therefore, the rod-side port 34 supplies gas to, and discharges gas from, the rod-side pressure chamber 42 through the through hole 56 and the rod cover chamber 54. A cushioning packing 58 such as an O-ring, which comes into sliding contact with the rod-side cushion pin 46 inserted into the rod cover chamber 54, is provided on the piston 38 side of the rod cover chamber 54.

The gas supplied to and discharged from the head-side pressure chamber 40 and the rod-side pressure chamber 42 is, for example, air. Therefore, the gas cylinder 10 according to the present embodiment is applied to, for example, an air cylinder.

Figure 4:
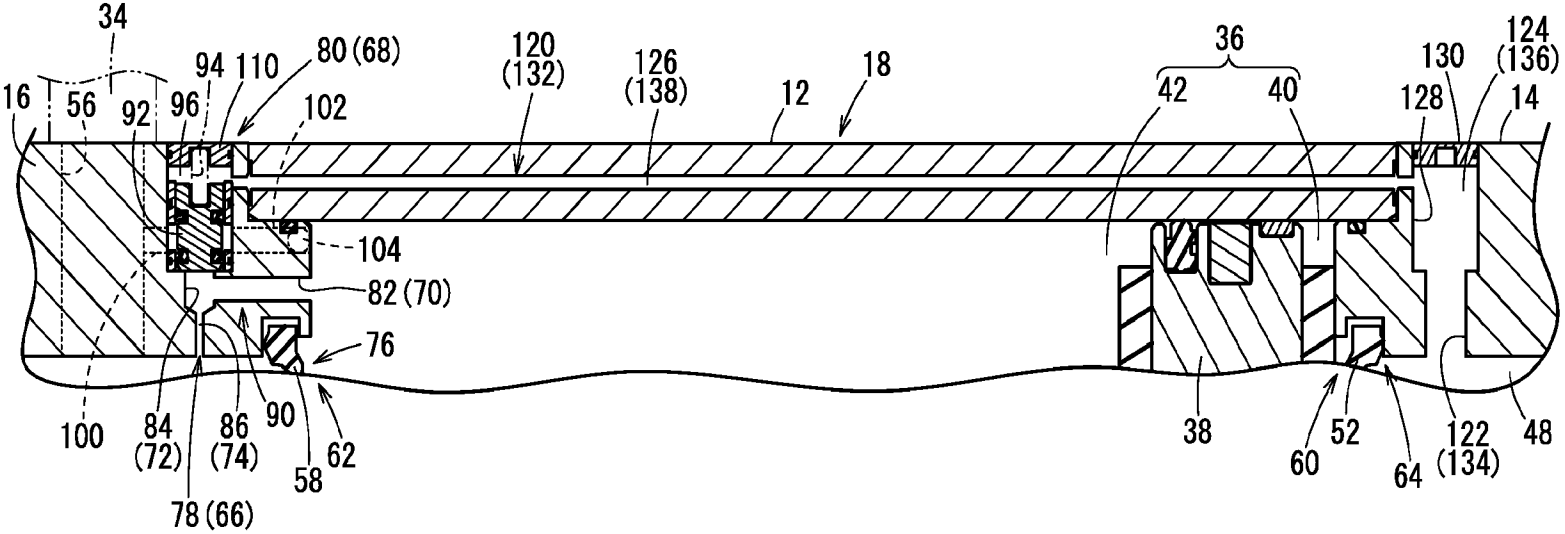
FIG. 4 is a partial sectional view taken along a line IV-IV in FIG. 2.
Figure 7:
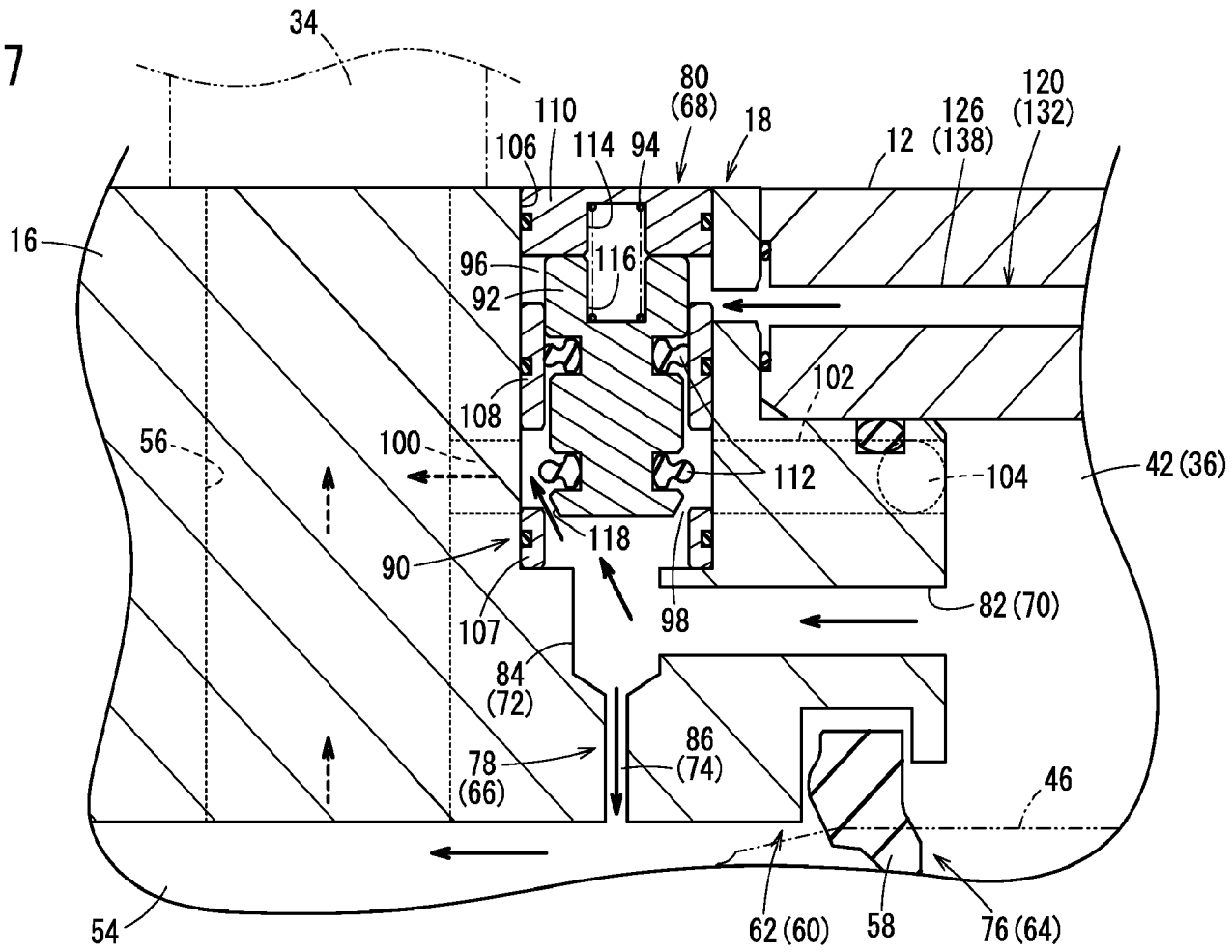
FIG. 7 is a partial sectional view showing the operation of the gas cylinder of FIG. 1.
Figure 8:
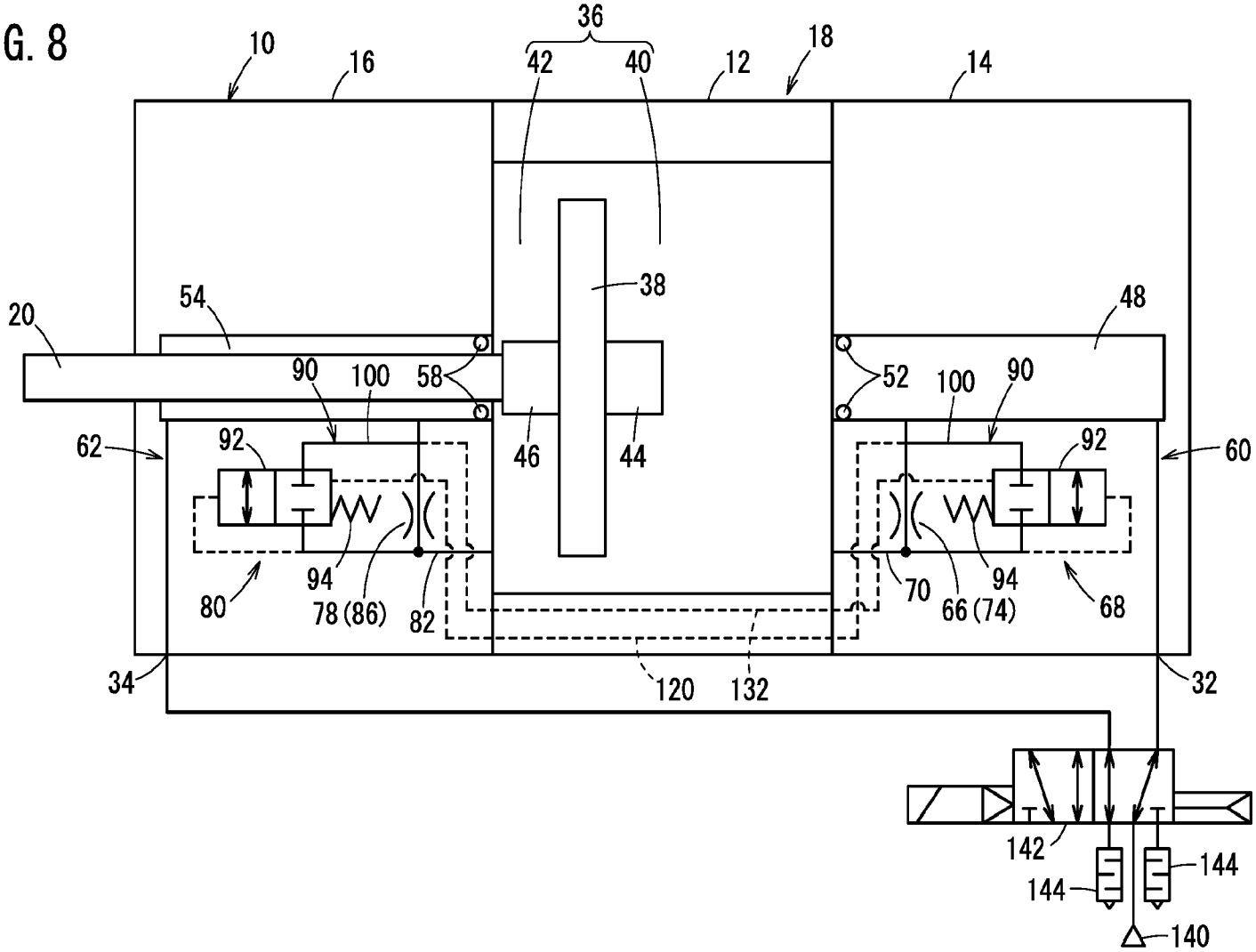
FIG. 8 is a fluid circuit diagram showing the operation of the gas cylinder of FIG. 1.

A head-side cushioning mechanism 60 for braking the motion of the piston 38 when the piston 38 stops at the stroke start end is provided on the head cover 14 side of the gas cylinder 10 (see FIGS. 3, 4 and 8). Further, a rod-side cushioning mechanism 62 for braking the motion of the piston 38 when the piston 38 stops at the stroke terminal end is provided on the rod cover 16 side of the gas cylinder 10 (see FIGS. 3 to 8).

It should be noted that, in the gas cylinder 10, the cushioning mechanism may be provided on at least one of the head cover 14 side and the rod cover 16 side. Further, when the piston 38 stops at the stroke end (stroke start end or the stroke terminal end), the space between the piston 38 and the stroke end (head-side pressure chamber 40 or rod-side pressure chamber 42) functions as a cushioning chamber.

The head-side cushioning mechanism 60 includes a communication shutoff portion 64 shutting off the communication between the head-side pressure chamber 40 and the head-side port 32 when the piston 38 approaches the stroke start end, an orifice portion 66 provided in the head cover 14 to discharge gas from the head-side pressure chamber 40, and a discharge flow rate regulator 68 provided in the head cover 14 to discharge gas from the head-side pressure chamber 40 in cooperation with the orifice portion 66. The orifice portion 66 and the discharge flow rate regulator 68 are arranged on the upper side (one side portion) of the piston rod 20 inside the head cover 14.

In the head-side cushioning mechanism 60, the communication shutoff portion 64 is constituted by the head-side cushion pin 44 and the cushioning packing 52. As the head-side cushion pin 44 and the cushioning packing 52 come into sliding contact with each other, the communication between the head-side pressure chamber 40 and the head-side port 32 is shut off. Further, in the head-side cushioning mechanism 60, the orifice portion 66 is formed of an upstream side flow passage 70 (first flow passage) that extends inside the head cover 14 in the axial direction to communicate with the head-side pressure chamber 40, a downstream side flow passage 72 (second flow passage) that is connected to the downstream side of the flow passage 70 and vertically extends inside the head cover 14, and an orifice 74 that is smaller in diameter than the flow passage 72 and connects the lower side of the flow passage 72 and the head cover chamber 48. Therefore, when the communication between the head-side pressure chamber 40 and the head-side port 32 is shut off, the gas in the head-side pressure chamber 40 passes from the flow passages 70, 72 through the orifice 74 to the head cover chamber 48, and is discharged through the through hole 50 and the head-side port 32.

The rod-side cushioning mechanism 62 includes a communication shutoff portion 76 shutting off the communication between the rod-side pressure chamber 42 and the rod-side port 34 when the piston 38 approaches the stroke terminal end, an orifice portion 78 provided in the rod cover 16 to discharge gas from the rod-side pressure chamber 42, and a discharge flow rate regulator 80 provided in the rod cover 16 to discharge gas from the rod-side pressure chamber 42 in cooperation with the orifice portion 78. The orifice portion 78 and the discharge flow rate regulator 80 are arranged on the upper side (one side portion) of the piston rod 20 inside the rod cover 16.

In the rod-side cushioning mechanism 62, the communication shutoff portion 76 is constituted by the rod-side cushion pin 46 and the cushioning packing 58. As the rod-side cushion pin 46 and the cushioning packing 58 come into sliding contact with each other, the communication between the rod-side pressure chamber 42 and the rod-side port 34 is shut off. Further, in the rod-side cushioning mechanism 62, the orifice portion 78 is formed of an upstream side flow passage 82 (first flow passage) that extends inside the rod cover 16 in the axial direction to communicate with the rod-side pressure chamber 42, a downstream side flow passage 84 (second flow passage) that is connected to the downstream side of the flow passage 82 and vertically extends inside the rod cover 16, and an orifice 86 that is smaller in diameter than the flow passage 84 and connects the lower side of the flow passage 84 and the rod cover chamber 54. Therefore, when the communication between the rod-side pressure chamber 42 and the rod-side port 34 is shut off, the gas in the rod-side pressure chamber 42 passes from the flow passages 82, 84 through the orifice 86 to the rod cover chamber 54, and is discharged through the through hole 56 and the rod-side port 34.

In the head-side cushioning mechanism 60 and the rod-side cushioning mechanism 62, the configurations of the orifice portions 66 and 78 are substantially the same and the configurations of the discharge flow rate regulators 68 and 80 are substantially the same. For this reason, the following description will be mainly given on the orifice portion 78 and the discharge flow rate regulator 80 of the rod-side cushioning mechanism 62 with reference to FIGS. 4 to 8. Therefore, it should be noted that the head-side cushioning mechanism 60 and the rod-side cushioning mechanism 62 may be described by allotting the same reference numerals to the equivalent components between the orifice portion 66 and the discharge flow rate regulator 68, and the orifice portion 78 and the discharge flow rate regulator 80.

The discharge flow rate regulator 80 is formed in the rod cover 16, and includes a discharge flow passage 90 for discharging the gas from the rod-side pressure chamber 42 to the outside, a spool-type valve element 92 disposed in the middle of the discharge flow passage 90, a spring member 94 (elastic element) biasing a first end of the valve element 92 to the upstream side of the discharge flow passage 90, and an accommodation chamber 96 (gas storage portion) that is formed in the rod cover 16 and can accommodate the second end of the valve element 92.

The discharge flow passage 90 is formed of the flow passage 82 as the first flow passage, the flow passage 84 as the second flow passage, a flow passage 98 (third flow passage) that has a greater diameter than the flow passage 84 and extends upward from the downstream side of the flow passage 84, and a flow passage 100 (fourth flow passage) that is connected to the flow passage 98 and extends in the axial direction to communicate with the through hole 56. Therefore, the flow passage 84 and the flow passage 98 has a stepped connected portion therebetween. Further, the flow passage 100 communicates with the rod-side port 34 via the through hole 56.

In the rod cover 16, a passage 102 extending from the rod-side pressure chamber 42 toward the flow passage 98 is formed substantially coaxially with the flow passage 100. The passage 102 is a prepared hole for forming the flow passage 100 with a drill or the like, and is sealed with a steel ball 104.

The flow passage 98 is formed by a hole 106 extending vertically in the rod cover 16. That is, the lower end (one end) of the hole 106 communicates with the flow passage 84 while the upper end (other end) thereof opens on the upper surface of the rod cover 16 to communicate with the outside. Multiple sleeves 107 and 108 are inserted in the holes 106.

One of the sleeves, namely, the sleeve 107 is inserted on the inner side (flow passage 84 side) of the hole 106. That is, the sleeve 107 is arranged in the hole 106 below the flow passage 100 and the passage 102 and above the flow passage 84. The other of the sleeves, namely the sleeve 108 is inserted on the outer side of the hole 106. That is, the sleeve 108 is arranged on the opening side of the flow passages 100 and 102 in the hole 106.

The valve element 92 is arranged inside the sleeves 107 and 108 so as to be slidable in the vertical direction. The upper end of the hole 106 is closed by a lid 110. Thus, the space between the lid 110 and the sleeve 108 in the hole 106 is formed as the accommodation chamber 96. Further, a portion in the hole 106 on the flow passage 84 side of the sleeve 108 is formed as the flow passage 98.

Figure 5:
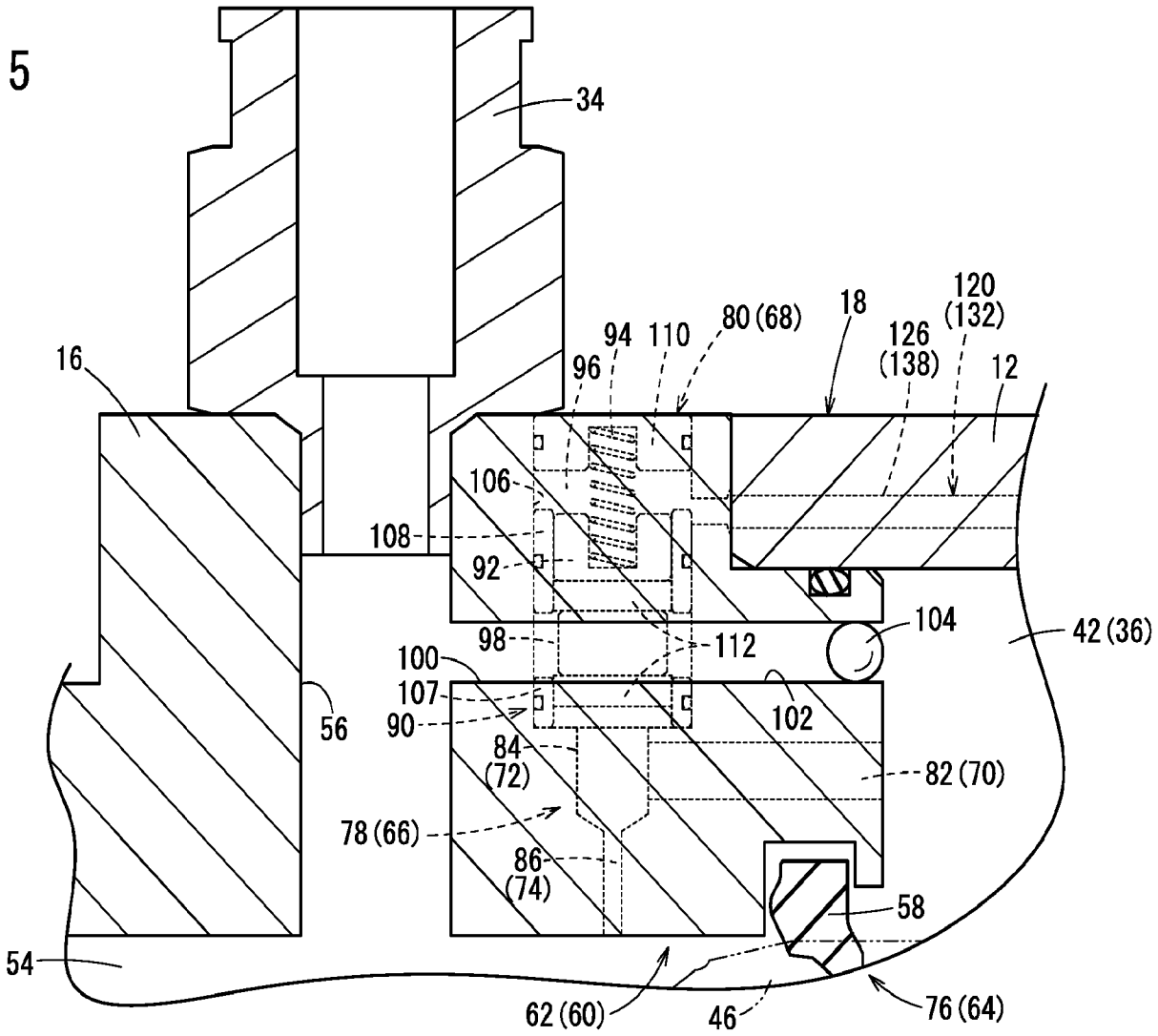
FIG. 5 is a partial sectional view taken along a line V-V in FIG. 2.
Figure 6:
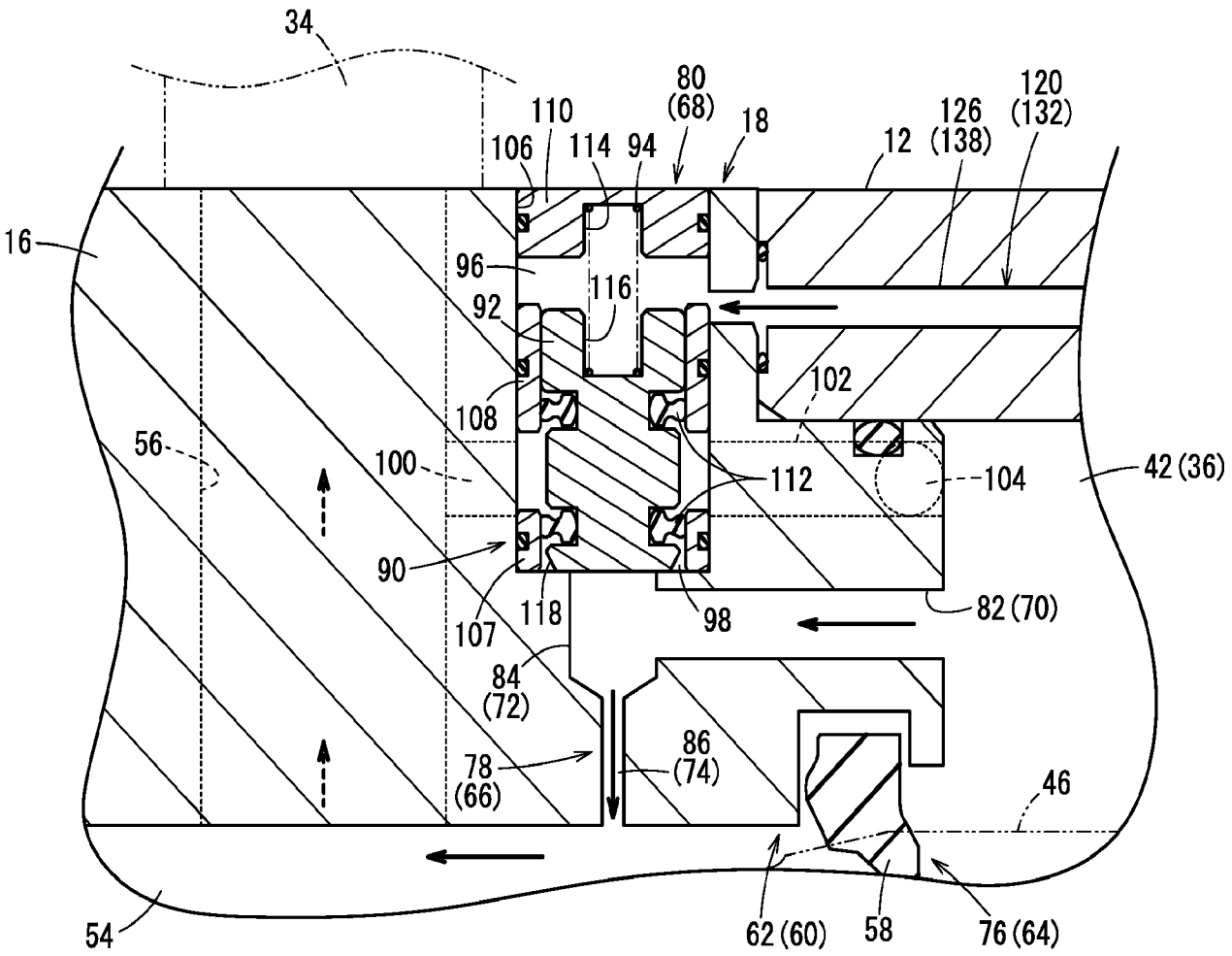
FIG. 6 is a partial sectional view showing the operation of the gas cylinder of FIG. 1.

FIGS. 5 to 7 show a case where the two sleeves 107 and 108 are inserted in the holes 106. In the present embodiment, instead of the two sleeves 107 and 108, one sleeve having a hole that allows communication between the passage 100 and the passage 102 can be inserted in the hole 106.

The valve element 92 is a columnar spool valve disposed from the flow passage 84 to the accommodation chamber 96. Sealing members 112 such as O-rings that come into sliding contact with the inner circumferential surfaces of the sleeves 107 and 108 are provided on the peripheral surface of the valve element 92. FIGS. 5 to 7 show an example case where the seal members 112 are disposed at two locations on the peripheral surface of the valve element 92.

In the accommodation chamber 96, the spring member 94 is placed between a depression 114 formed in the center of the undersurface of the lid 110 and a depression 116 formed in the center of the top endface of the valve element 92. The spring member 94 biases the valve element 92 downward (toward the flow passage 84). The peripheral surface on the bottom side of the valve element 92 is provided with a tapered portion 118 which is reduced in diameter from the upper side (from the flow passage 98 side) to the lower side (to the flow passage 84 side).

Further, the gas cylinder 10 further includes a supply passage 120 for supplying, to the accommodation chamber 96, a part of the gas supplied from the head-side port 32 to the head-side pressure chamber 40 (see FIGS. 2 and 4 to 8). The supply passage 120 includes a first internal passage 122 extending upward from the head cover chamber 48, a second internal passage 124 extending upward from the first internal passage 122 and having a larger diameter than the first internal passage 122, and a third internal passage 126 extending in the axial direction and communicating at its one end with the second internal passage 124 and communicating at its other end with the accommodation chamber 96.

The first internal passage 122 has substantially the same inside diameter as the flow passages 72 and 84. The second internal passage 124 is formed by a hole 128 extending in the vertical direction in the head cover 14. That is, the hole 128 has substantially the same inside diameter as the hole 106 described above with its lower end (one end) communicating with the first internal passage 122 and its upper end (the other end) opening on the upper surface of the head cover 14 to communicate with the outside. The upper end of the hole 128 is closed by a lid 130 having the same shape as the lid 110. Thus, the space between the lid 130 and the first internal passage 122 in the hole 128 is formed as the second internal passage 124.

The third internal passage 126 is formed of a passage that extends in the axial direction in the head cover 14 to communicate with the second internal passage 124, a passage that extends in the axial direction in the cylinder tube 12, and a passage that extends in the axial direction in the rod cover 16 to communicate with the accommodation chamber 96.

In the above description, in consideration of reducing the processing cost and enabling use of the common part for the lids 110 and 130, the hole 128 is formed in the same shape as the hole 106 so as to form the first internal passage 122 and the second internal passage 124. Therefore, in the present embodiment, the hole 128 may have a shape different from that of the hole 106, or the hole 128 may form one internal passage. That is, the supply passage 120 (first to third internal passages 122 to 126) may have any shape as long as the head cover chamber 48 and the accommodation chamber 96 can be connected.

The orifice portion 78 and the discharge flow rate regulator 80 of the rod-side cushioning mechanism 62 and the supply passage 120 have been described above. The orifice portion 66 and the discharge flow rate regulator 68 of the head-side cushioning mechanism 60 will be understood by, for example, replacing the term "rod" with "head".

Further, the discharge flow rate regulator 68 of the head-side cushioning mechanism 60 also includes, as shown in FIG. 2, a supply passage 132 for supplying, to the accommodation chamber 96 of the discharge flow rate regulator 68, a part of the gas supplied from the rod-side port 34 to the rod-side pressure chamber 42. As described above, the holes 106 and 128 have substantially the same inside diameter, and the lids 110 and 130 have the same shape. That is, in the gas cylinder 10, the head cover 14 and the rod cover 16 have substantially the same configuration except that the piston rod 20 penetrates through the rod cover 16.

The supply passage 132 includes a first internal passage 134 and a second internal passage 136 that are formed in the hole 128 on the rod cover 16 side, and a third internal passage 138 extending in the axial direction and communicating at its one end with the second internal passage 136 and communicating at its other end with the accommodation chamber 96 of the discharge flow rate regulator 68. In this case, the first to third internal passages 134 to 138 correspond to the first to third internal passages 122 to 126 constituting the supply passage 120. Thus, this configuration makes it possible to facilitate the production of the gas cylinder 10 and reduce the production cost.

2. Operation of the Embodiment

The operation of the gas cylinder 10 according to the present embodiment thus configured will be described. Here, referring to FIG. 8, explanation will be given on the operation of the rod-side cushioning mechanism 62 (cushioning mechanism) when the piston 38 is brought to the stroke terminal end (stroke end) on the rod cover 16 (first cover) side by supplying gas from a gas supply source 140 to the head-side pressure chamber 40 via a solenoid valve 142 and the head-side port 32, while discharging gas from the rod-side pressure chamber 42 via the rod-side port 34 and the solenoid valve 142. The solenoid valve 142 is, for example, a 4-way 5 port single solenoid valve, and silencers 144 are connected to the ports thereof on the discharge side.

Before explaining the operation of the gas cylinder 10 according to the present embodiment, the operation of a gas cylinder of a comparative example will be briefly described. The gas cylinder of the comparative example is a gas cylinder having none of the accommodation chamber 96 and supply passages 120 and 132 (see FIGS. 2 and 4 to 8). The operation of the gas cylinder of the comparative example will be described by referring to the components of the gas cylinder 10, as necessary.

Also in the gas cylinder of the comparative example, first, gas is started to be supplied from the head-side port (second port) to the head-side pressure chamber 40 (second pressure chamber) via the through hole 50 and the head cover chamber 48 while discharge of gas from the rod-side pressure chamber 42 (first pressure chamber) through the rod cover chamber 54, the through hole 56 and the rod-side port 34 (first port) is started. As a result, the piston 38 is moved in the axial direction toward the rod cover 16 side, and the piston rod 20 projects axially from the rod cover 16.

Next, when the rod-side cushion pin 46 enters the rod cover chamber 54, the rod-side cushion pin 46 and the cushioning packing 58 of the rod cover chamber 54 come into sliding contact with each other. This shuts off the communication between the rod-side port 34 and the rod-side pressure chamber 42 via the rod cover chamber 54. As a result, the pressure in the rod-side pressure chamber 42 rises. Then, in the gas cylinder of the comparative example, gas is discharged from the rod-side pressure chamber 42 by the method using a meter-out circuit as described below.

In this case, the gas in the rod-side pressure chamber 42 is discharged from the rod-side port 34 via the orifice portion 78 (two flow passages 82, 84 and the orifice 86), the rod cover chamber 54 and the through hole 56. Here, when the pressure in the rod-side pressure chamber 42 is equal to or lower than a prescribed threshold (prescribed pressure), the first end of the valve element 92 abuts the stepped portion between the two flow passages 84 and 98 by the biasing force of the spring member 94. Thereby, the interface between the flow passage 84 and the flow passage 98 is clogged so that the communication between the flow passage 84 and the flow passage 98 is shut off.

Next, when the pressure in the rod-side pressure chamber 42 exceeds the prescribed pressure, the valve element 92 is moved upward (to the flow passage 98 side) due to the pressure against the biasing force of the spring member 94. Since the valve element 92 is a valve element of a spool type, it is moved upward according to the magnitude of the pressure in the rod-side pressure chamber 42. This causes the first end of the valve element 92 to separate from the interface between the flow passage 84 and the flow passage 98 and create a slight gap between the tapered portion 118 at the first end of the valve element 92 and the interface. As a result, the two flow passages 84 and 98 communicate with each other, and the gas in the rod-side pressure chamber 42 is discharged to the outside from the rod-side port 34 through the orifice portion 78, the rod cover chamber 54 and the through hole 56, and from the rod-side port 34 through the flow passages 98, 100 and the through hole 56. That is, when the pressure in the rod-side pressure chamber 42 exceeds the prescribed pressure, the gas in the rod-side pressure chamber 42 is discharged through the two routes. Here, as the valve element 92 moves upward, the spring member 94 contracts. Thereafter, the piston 38 reaches the stroke terminal end.

Conventionally, a gas cylinder would undergo a bouncing phenomenon in which the piston 38 is temporarily pushed back to the head cover 14 side during movement (in stroke). The bouncing phenomenon occurs when the pressure in the rod-side pressure chamber 42, which is a cushioning chamber, is greatly compressed and rises sharply as the piston 38 moves toward the stroke terminal end. That is, the bouncing phenomenon occurs when the balance between the thrust of the piston 38 due to the pressure in the cushioning chamber (the pressure in the rod-side pressure chamber 42) and the thrust of the piston 38 due to the pressure in the head-side pressure chamber 40 is lost. If a bouncing phenomenon occurs, the cycle time of the gas cylinder becomes long, resulting in production losses in the production facility to which the gas cylinder is applied.

To deal with this, in the gas cylinder of the comparative example, as described above, when the pressure in the rod-side pressure chamber 42 exceeds the prescribed pressure, the valve element 92 moves upward (to the flow passage 98 side), against the biasing force of the spring member 94 so as to discharge gas from the rod-side pressure chamber 42 through two routes, whereby the occurrence of the bouncing phenomenon is avoided. However, in the gas cylinder of the comparative example, the prescribed pressure is a fixed value that is uniquely specified based on the biasing force of the spring member 94. Therefore, when the prescribed pressure is to be adjusted according to the specifications required by the user, it is necessary to prepare multiple spring members 94 having different biasing forces beforehand, select the spring member 94 having an optimal biasing force suited to the specifications from among the multiple spring members 94, and set the selected spring member 94. This makes the adjustment work for changing the prescribed pressure troublesome and costly.

The gas cylinder 10 according to the present embodiment is different from the gas cylinder of the comparative example in that a part of the gas supplied from the head-side port 32 (second port) to the head-side pressure chamber 40 (second pressure chamber) via the through hole 50 and the head cover chamber 48 is supplied to the accommodation chamber 96 via the supply passage 120 (see FIGS. 2 and 4 to 8). As a result, the prescribed pressure, which is the threshold for moving the valve element 92, varies depending on the pressure in the accommodation chamber 96, that is, the pressure of the gas supplied from the head-side port 32 to the head-side pressure chamber 40 (the operating pressure of the piston 38). In other words, even when the biasing force of the spring member 94 is constant, the prescribed pressure varies according to the differential pressure between the pressure in the rod-side pressure chamber 42 as the cushioning chamber, and the pressure in the head-side pressure chamber 40 as the compression chamber.

Figure 9:
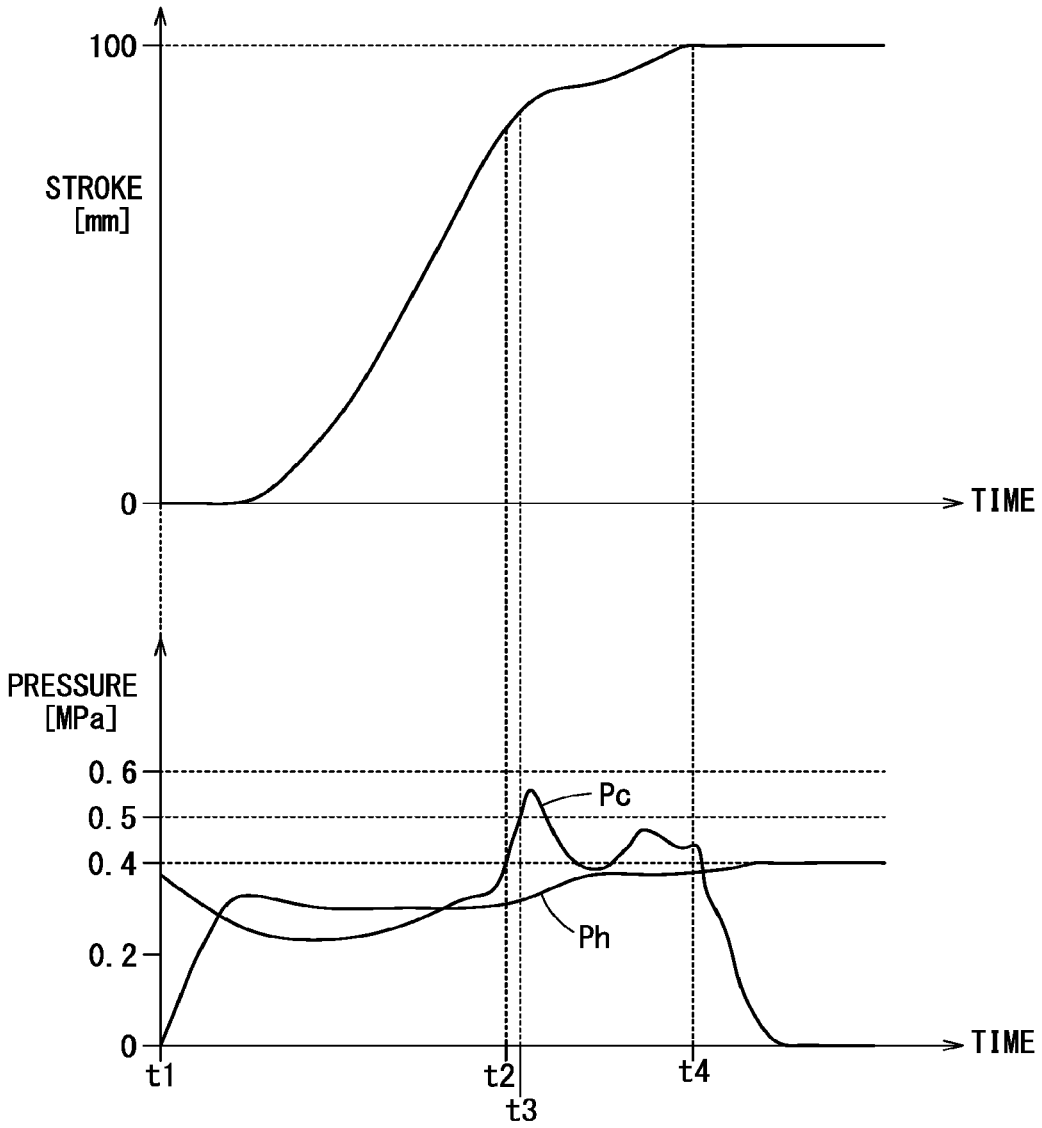
FIG. 9 is a timing chart showing the operation of the gas cylinder of FIG. 1.
Figure 10:
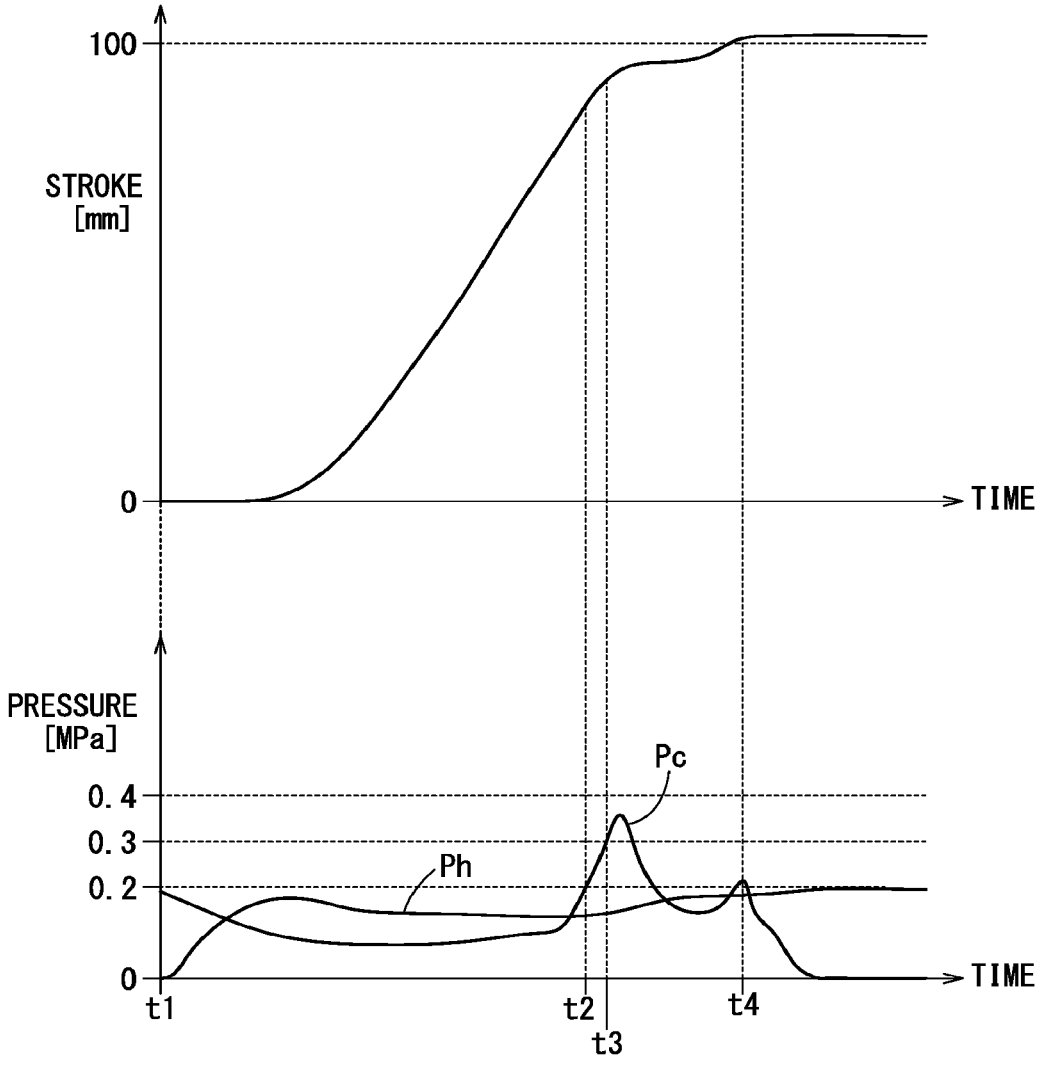
FIG. 10 is a timing chart showing the operation of the gas cylinder of FIG. 1.
Figure 11:
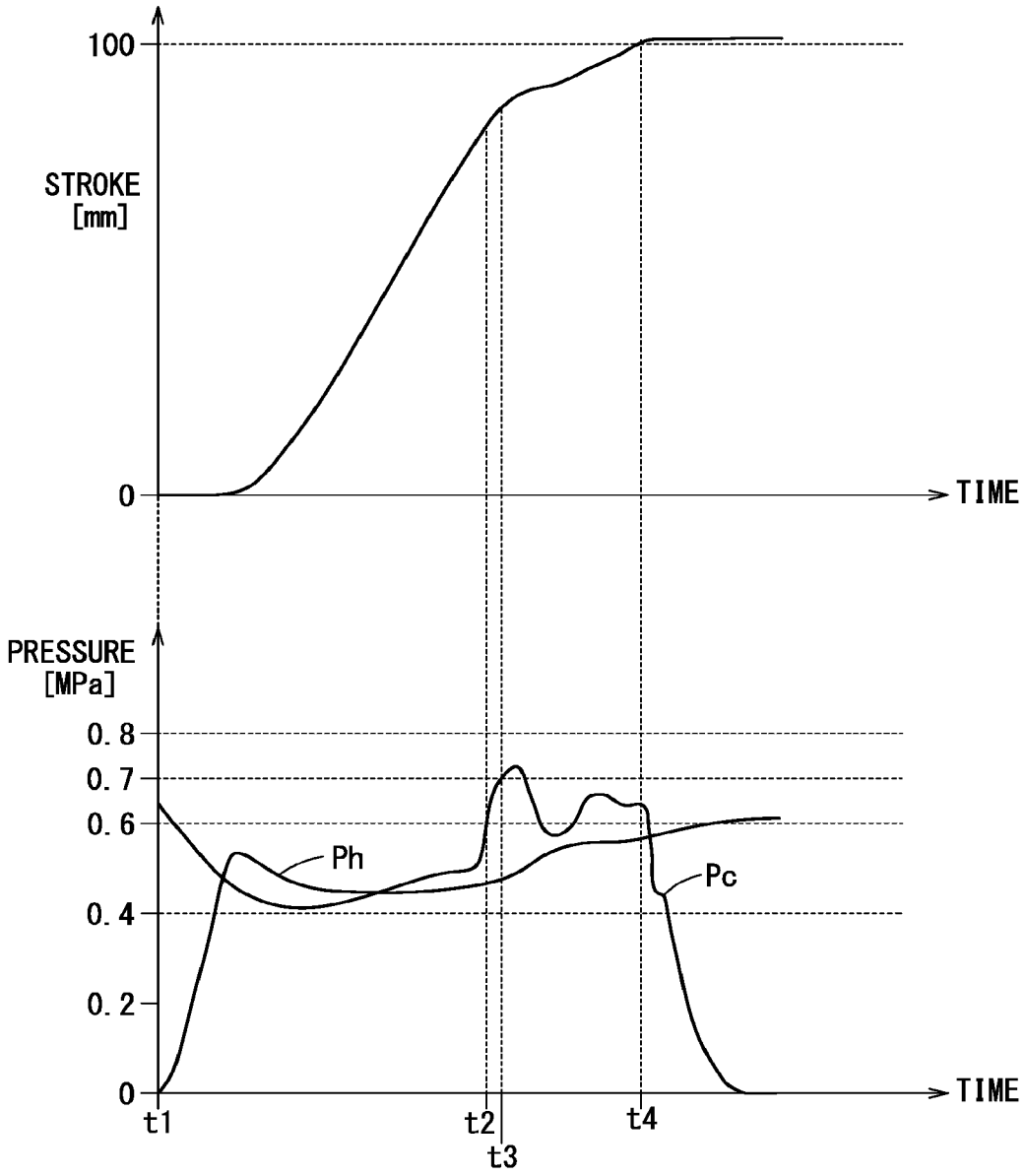
FIG. 11 is a timing chart showing the operation of the gas cylinder of FIG. 1.

FIGS. 9 to 11 are timing charts showing the operation (example) of the gas cylinder 10 according to the present embodiment. Pc is the pressure (cushioning pressure) in the rod-side pressure chamber 42. Further, Ph is the pressure (head-side pressure, operating pressure) of the gas in the head-side pressure chamber 40. The biasing force of the spring member 94 is set according to the differential pressure between the prescribed pressure and the operating pressure (for example, 0.1 MPa in each of the examples of FIGS. 9 to 11).

The example of FIG. 9 shows a timing chart when the prescribed pressure is set at 0.5 MPa. In this case, the operating pressure corresponding to the prescribed pressure is 0.4 MPa. Further, in this example, a bouncing phenomenon occurs when the cushioning pressure (pressure Pc) reaches about 0.6 MPa.

At time t1 in FIG. 9, gas supply is started from the head-side port 32 (second port) to the head-side pressure chamber 40 (second pressure chamber) via the head cover chamber 48 while gas discharge is started from the rod-side pressure chamber 42 (the first pressure chamber) via the rod cover chamber 54 and the rod-side port 34 (first port). In this case, a part of the gas supplied to the head cover chamber 48 is supplied to the accommodation chamber 96 via the supply passage 120.

As a result, Ph increases with the passage of time from time t1. Pc decreases temporarily, but generally is kept at the prescribed pressure. Thereby, the piston 38 is moved in the axial direction toward the rod cover 16 side, so that the piston rod 20 projects axially from the rod cover 16.

Next, when the rod-side cushion pin 46 enters the rod cover chamber 54 so that the rod-side cushion pin 46 and the cushioning packing 58 of the rod cover chamber 54 come into sliding contact with each other, the communication between the rod-side port 34 and the rod-side pressure chamber 42 via the rod cover chamber 54 is shut off. As a result, the pressure in the rod-side pressure chamber 42 rises. In this case, as shown in FIG. 6, the gas in the rod-side pressure chamber 42 passes through the orifice portion 78 (the two flow passages 82, 84 and the orifice 86), the rod cover chamber 54 and the through hole 56, and is discharged from the rod-side port 34.

In the embodiment, the prescribed pressure takes a pressure value based on the biasing force of the spring member 94 and the pressure in the accommodation chamber 96, or the pressure (operating pressure) of the head-side pressure chamber 40. In the example of FIG. 9, the prescribed pressure is 0.5 MPa, as described above. Therefore, when the pressure in the rod-side pressure chamber 42 is equal to or lower than the prescribed pressure, the valve element 92 is moved to the flow passage 84 side by the biasing force of the spring member 94 and the pressure in the accommodation chamber 96, so as to close the interface between the flow passage 98 and the flow passage 84. As a result, the communication between the flow passage 84 and the flow passage 98 is shut off.

On the other hand, when the pressure in the rod-side pressure chamber 42 sharply rises and exceeds a prescribed operating pressure (0.4 MPa) at time t2 and exceeds the prescribed pressure (0.5 MPa) at time t3, the valve element 92 moves upward (to the flow passage 98 side) against the biasing force of the spring member 94.

Thus, the valve element 92 is moved upward according to the magnitude of the pressure in the rod-side pressure chamber 42, and the first end of the valve element 92 separates from the interface between the flow passage 84 and the flow passage 98, whereby a slight gap is formed between the tapered portion 118 at the first end of the valve element 92 and the interface. As a result, the two flow passages 84 and 98 communicate with each other, and the gas in the rod-side pressure chamber 42 is discharged to the outside from the rod-side port 34 through the orifice portion 78, the rod cover chamber 54 and the through hole 56 and is also discharged from the rod-side port 34 through the flow passages 98, 100 and the through hole 56.

In this way, when exceeding the prescribed pressure, the gas in the rod-side pressure chamber 42 is discharged through the two routes. As a result, after time t3, the pressure in the rod-side pressure chamber 42 is prevented from reaching the pressure at which a bouncing phenomenon takes place (about 0.6 MPa). Also in this case, the spring member 94 contracts due to the upward movement of the valve element 92.

As the pressure in the rod-side pressure chamber 42 further increases, the valve element 92 further moves upward, the gap between the valve element 92 and the tapered portion 118 becomes greater, and the spring member 94 further contracts.

As a result, in the example, the piston 38 can be quickly brought closer to the stroke terminal end side in the time range from time t2 to time t4 without causing a bouncing phenomenon. Then, at time t4, the piston 38 reaches the stroke terminal end.

The example of FIG. 10 shows a timing chart when the prescribed pressure is set at 0.3 MPa. In this case, the operating pressure corresponding to the prescribed pressure is 0.2 MPa. Further, in this example, a bouncing phenomenon occurs when the cushioning pressure (pressure Pc) reaches about 0.4 MPa.

The example of FIG. 11 shows a timing chart when a prescribed pressure is set at 0.7 MPa. In this case, the operating pressure corresponding to the prescribed pressure is 0.6 MPa. Further, in this example, a bouncing phenomenon occurs when the cushioning pressure (pressure Pc) reaches about 0.8 MPa.

In the examples of FIGS. 10 and 11, similarly to the example of FIG. 9, the cushioning pressure (pressure Pc) starts to rise sharply at time t2, and when the prescribed pressure is reached at time t3, the valve element 92 moves so as to create communication between the flow passage 84 and the flow passage 98. As a result, the piston 38 can reach the stroke terminal end without causing a bouncing phenomenon.

3. Modification

The above description has been made of a case where the orifice portion 78 and the discharge flow rate regulator 80 are provided for the rod cover 16 and the orifice portion 66 and the discharge flow rate regulator 68 are provided for the head cover 14. In the gas cylinder 10 according to the present embodiment, the orifice portion 78 and the discharge flow rate regulator 80 can be externally provided to the cylinder body 18.

Further, in the gas cylinder 10 according to the present embodiment, the supply passages 120 and 132 can be externally provided to the cylinder body 18.

Further, the spool-type valve element 92 has been explained in the above description. In the gas cylinder 10 according to the present embodiment, instead of the spool-type valve element 92, a diaphragm type, pivot type or needle type valve element may be used. In short, any type of valve element can be adopted as long as the valve element enables communication and shut-off between the flow passage 84 (flow passage 72) and the flow passage 98.

4. Effect of the Embodiment

As described above, the gas cylinder 10 according to the present embodiment includes: a cylinder tube 12 having a cylinder chamber 36 formed therein; a first cover (one of the head cover 14 and the rod cover 16) that closes one end of the cylinder tube 12); a second cover (the other of the head cover 14 and the rod cover 16) that closes the other end of the cylinder tube 12; a piston 38 that partitions the cylinder chamber 36 into a first pressure chamber (one of the head-side pressure chamber 40 and the rod-side pressure chamber 42) on the first cover side, and a second pressure chamber (the other of the head-side pressure chamber 40 and the rod-side pressure chamber 42) on the second cover side, and slides in the cylinder chamber 36; a piston rod 20 connected to the piston 38; a first port (one of the head-side port 32 and the rod-side port 34) through which gas is supplied to and discharged from the first pressure chamber; a second port (the other of the head-side port 32 and the rod-side port 34) through which gas is supplied to and discharged from the second pressure chamber; and a cushioning mechanism (head-side cushioning mechanism 60, rod-side cushioning mechanism 62) that brakes the motion of the piston 38 at least when the piston 38 stops at the stroke end (the stroke start end or the stroke terminal end) on the first cover side.

The cushioning mechanism includes: a communication shutoff portion 64, 76 that shuts off the communication between the first pressure chamber and the first port when the piston 38 approaches the stroke end; an orifice portion 66, 78 through which gas is discharged from the first pressure chamber; and a discharge flow rate regulator 68, 80 that discharges gas from the first pressure chamber in cooperation with the orifice portion 66, 78.

The discharge flow rate regulator 68, 80 includes: a discharge flow passage 90 for discharging gas in the first pressure chamber; a valve element 92 for opening and closing the discharge flow passage 90; a spring member 94 (elastic element) that closes the discharge flow passage 90 with a distal end (first end) of the valve element 92 by biasing a proximal end (second end) of the valve element 92 to move the valve element 92; and an accommodation chamber 96 (gas storage portion).

The gas cylinder 10 further includes a supply passage 120, 132 for supplying, to the accommodation chamber 96, a part of the gas supplied to the second port. Here, when the pressure in the first pressure chamber is equal to or lower than a prescribed pressure that is based on the biasing force of the spring member 94 and the pressure in the accommodation chamber 96, the valve element 92 closes the discharge flow passage 90 by the biasing force and the pressure in the accommodation chamber 96. On the other hand, when the pressure in the first pressure chamber exceeds the prescribed pressure, the valve element 92 is moved due to the pressure in the first pressure chamber, against the biasing force and the pressure in the accommodation chamber 96, so as to open the discharge flow passage 90.

As already mentioned, a bouncing phenomenon occurs when the pressure in the first pressure chamber (cushioning chamber) is greatly compressed and rises sharply as the piston 38 moves toward the stroke end on the first cover side. That is, the bouncing phenomenon takes place when the balance between the thrust of the piston 38 due to the pressure in the cushioning chamber and the thrust of the piston 38 due to the pressure in the second pressure chamber is lost.

To deal with this, in the gas cylinder 10 according to the present embodiment, a part of the gas supplied from the second port to the second pressure chamber is supplied to the accommodation chamber 96 via the supply passage 120. This causes the prescribed pressure, which is the threshold for moving the valve element 92, to change depending on the pressure in the accommodation chamber 96, that is, the pressure of the gas supplied from the second port to the second pressure chamber (operating pressure of the piston 38). In other words, even when the biasing force of the spring member 94 is constant, the prescribed pressure varies according to the differential pressure between the pressure in the cushioning chamber and the pressure in the compression chamber.

In the above way, in the gas cylinder 10 according to the present embodiment, the prescribed pressure is adjusted by utilizing the pressure in the accommodation chamber 96. As a result, if the spring member 94 having an optimum biasing force is installed in consideration of the differential pressure between the pressure in the first pressure chamber and the pressure in the second pressure chamber, it is possible to automatically adjust the prescribed pressure even when the pressure in the second pressure chamber changes. That is, it is not necessary to replace the spring member 94 to adjust the prescribed pressure.

Further, in the gas cylinder 10 according to the present embodiment, when the pressure in the first pressure chamber is equal to or lower than the prescribed pressure, the first end of the valve element 92 closes the discharge flow passage 90 by the effect of the biasing force from the spring member 94 and the pressure in the accommodation chamber 96. As a result, the gas in the cushioning chamber is discharged only through the orifice portion 66, 78.

On the other hand, when the pressure in the first pressure chamber exceeds the prescribed pressure, the pressure causes the valve element 92 to move, against the biasing force and the pressure in the accommodation chamber 96 and open the discharge flow passage 90. As a result, the gas in the first pressure chamber is discharged through the orifice portion 66, 78 and also through the discharge flow passage 90.

In this way, when the pressure in the first pressure chamber exceeds the prescribed pressure, the gas in the first pressure chamber is discharged through two routes. Thereby, the gas in the first pressure chamber is discharged in a short time, and the piston 38 can reach the stroke end quickly and smoothly. As a result, the responsiveness of the gas cylinder can be improved while avoiding the occurrence of the bouncing phenomenon.

Further, as the valve element 92 is moved due to the balance (differential pressure) between the biasing force of the spring member 94 and the pressure in the accommodation chamber 96, and the pressure in the first pressure chamber, the state of the discharge flow passage 90 is switched from open to closed or vice versa. This eliminates the need for manual adjustment of the valve element 92. As a result, when the discharge flow passage 90 is in the open state, the degree of opening of the valve element 92 can be gradually changed depending on the magnitude of the pressure in the first pressure chamber.

Therefore, in the gas cylinder 10 according to the present embodiment, it is possible to automatically adjust the prescribed pressure without the need for manual adjustment of the valve element 92, and also realize smooth arrival of the piston 38 at the stroke end and alleviate the impact on the piston 38 while suppressing the occurrence of the bouncing phenomenon.

In this case, since the orifice portion 66, 78 and the discharge flow rate regulator 68, 80 are provided in the first cover (head cover 14 or rod cover 16), the components of the gas cylinder 10 are concentrated in a limited space. Further, the supply passages 120 and 132 include first to third internal passages 122 to 126, and 134 to 138 (internal passages), respectively, which extend along the cylinder chamber 36 inside the cylinder tube 12 with their one end connected to the second port and the other end connected to the accommodation chamber 96. As a result, gas can be easily supplied from the second port to the accommodation chamber 96. Further, since the first to third internal passages 122 to 126 and 134 to 138 are formed in the gas cylinder 10, there is no need to externally attach any supply passages.

Further, in the gas cylinder 10, the first port is provided on the first cover, and the second port is provided on the second cover. In this case, the discharge flow passage 90 is formed of a flow passage 70, 82 (first flow passage) communicating with the first pressure chamber, a flow passage 72, 84 (second flow passage) connected to the downstream side of the flow passage 70, 82, a flow passage 98 (third flow passage) that is connected to the downstream side of the flow passage 72, 84 and has a larger diameter than the flow passage 72, 84, and a flow passage 100 (fourth flow passage) that is connected to the flow passage 98 and communicates with the first port. The valve element 92 has a larger diameter than the flow passage 72, 84, and one end thereof is disposed in the flow passage 98.

When the pressure in the first pressure chamber is equal to or lower than the prescribed pressure, the valve element 92 is moved to the flow passage 72, 84 side due to the biasing force of the spring member 94 and the pressure in the accommodation chamber 96 so that the first end of the valve element 92 closes the interface between the flow passage 72, 84 and the flow passage 98 to shut off the communication between the flow passage 72, 84 and the flow passage 98. On the other hand, when the pressure in the first pressure chamber exceeds the prescribed pressure, the valve element 92 is moved to the flow passage 98 side due to the pressure in the first pressure chamber, against the biasing force and the pressure in the accommodation chamber 96 so that the first end of the valve element 92 separates from the interface to create the communication between the flow passage 72, 84 and the flow passage 98.

Thus, this configuration can effectively suppress the occurrence of the bouncing phenomenon and facilitate smooth arrival of the piston 38 at the stroke end.

Further, a tapered portion 118 that is reduced in diameter from the flow passage 98 toward the flow passage 72, 84 is formed in the first end of the valve element 92 facing the interface. This configuration makes it possible to gradually change the degree of opening of the valve element 92 when the valve element 92 is moved depending on the gas pressure.

Further, the orifice portion 66, 78 has an orifice 74, 86 for discharging, to the first port, the gas flowing from the first pressure chamber through the flow passage 70, 82 and the flow passage 72, 84. This makes it possible to facilitate the fabrication of the first cover while reducing the number of flow passages in the first cover (head cover 14 or rod cover 16).

Further, since the valve element 92 is a spool type valve element, and the second end of the valve element 92 can be accommodated in the accommodation chamber 96, it is possible to efficiently open and close the discharge flow passage 90.

Further, the accommodation chamber 96 communicates with the outside and is closed by a lid 110 with the spring member 94 inserted between the lid 110 and the valve element 92. Thus, the spring member 94 can be easily set inside the first cover.

Further, the first cover is formed with a hole 106 having one end communicating with the flow passage 72, 84 and the other end communicating with the outside. Sleeves 107 and 108 are inserted in the hole 106, and the valve element 92 is slidably placed inside the sleeves 107 and 108. In this case, by closing the hole 106 by the lid 110, the portion of the hole 106 on the lid 110 side forms the accommodation chamber 96, and the portion of the hole 106 on the flow passage 72, 84 side forms the flow passage 98.

Thereby, the flow passage 98 and the accommodation chamber 96 can be easily formed. Further, by inserting the sleeves 107 and 108 into the holes 106, the dimensional error of the hole 106 can be absorbed by the sleeves 107 and 108. As a result, the valve element 92 can be smoothly slid along the inside of the sleeves 107 and 108.

Further, seal members 112 that come into sliding contact with the inner circumferential surfaces of the sleeves 107 and 108 are provided on the peripheral surface of the valve element 92. As a result, the space between the flow passage 98 and the accommodation chamber 96 can be reliably sealed, and in addition, the life of the gas cylinder 10 including the valve element 92 can be extended.

Further, the orifice portion 66, 78 and the discharge flow rate regulator 68, 80 are collectively arranged in one side portion with respect to the piston rod 20 inside the first cover. As a result, three of the four surfaces of the first cover can be used as mounting surfaces for the gas cylinder 10. This makes it possible to collectively arrange multiple gas cylinders 10 in a limited space. In addition, this facilitates production of the gas cylinder 10. Moreover, it is possible to realize the gas cylinder 10 that hold compatibility of external dimensions with the existing product.

Further, the spring member 94 is a spring member that biases the second end of the valve element 92. This makes it possible to reduce the cost of the gas cylinder 10.

It should be noted that the present invention is not limited to the above-described embodiment, and it goes without saying that various configurations can be adopted based on the contents described in this specification.

What is claimed is:

1. A gas cylinder, comprising:

a cylinder tube having a cylinder chamber formed therein;

a first cover configured to close one end of the cylinder tube;

a second cover configured to close another end of the cylinder tube;

a piston configured to partition the cylinder chamber into a first pressure chamber on a side of the first cover, and a second pressure chamber on a side of the second cover, and slide in the cylinder chamber;

a piston rod connected to the piston;

a first port through which gas is supplied to and discharged from the first pressure chamber;

a second port through which gas is supplied to and discharged from the second pressure chamber; and a cushioning mechanism configured to brake a motion of the piston at least when the piston stops at a stroke end on the side of the first cover, wherein:

the cushioning mechanism includes a communication shutoff portion configured to shut off communication between the first pressure chamber and the first port when the piston approaches the stroke end, an orifice portion configured to discharge gas from the first pressure chamber, and a discharge flow rate regulator configured to discharge gas from the first pressure chamber in cooperation with the orifice portion;

the discharge flow rate regulator includes:

a discharge flow passage configured to discharge gas in the first pressure chamber, a valve element configured to open and close the discharge flow passage, an elastic element configured to close the discharge flow passage with a distal end of the valve element by biasing a proximal end of the valve element to move the valve element, and a gas storage portion;

the gas cylinder further includes a supply passage configured to supply, to the gas storage portion, a part of gas supplied to the second port;

when a pressure in the first pressure chamber is equal to or lower than a prescribed pressure that is based on a biasing force of the elastic element and a pressure in the gas storage portion, the valve element closes the discharge flow passage by the biasing force and the pressure in the gas storage portion; and when the pressure in the first pressure chamber exceeds the prescribed pressure, the valve element is moved due to the pressure in the first pressure chamber, against the biasing force and the pressure in the gas storage portion, so as to open the discharge flow passage, wherein:

the orifice portion and the discharge flow rate regulator are provided in the first cover, the first port is provided on the first cover, the second port is provided on the second cover, the discharge flow passage is formed of a first flow passage communicating with the first pressure chamber, a second flow passage having an upstream side connected to a downstream side of the first flow passage, a third flow passage having an upstream side connected to a downstream side of the second flow passage and having a larger diameter than the second flow passage, and a fourth flow passage having an upstream side connected to the downstream side of the third flow passage and that communicates with the first port, the valve element has a larger diameter than the second flow passage and the distal end thereof is disposed in the third flow passage, the valve element is capable of moving forward and backward relative to an interface between the second flow passage and the third flow passage along the third flow passage inside the third flow passage, when the pressure in the first pressure chamber is equal to or lower than the prescribed pressure, the valve element is moved to a side of the second flow passage due to the biasing force and the pressure in the gas storage portion so that the distal end of the valve element closes the interface between the second flow passage and the third flow passage to shut off communication between the second flow passage and the third flow passage, and when the pressure in the first pressure chamber exceeds the prescribed pressure, the valve element is moved to a side of the third flow passage due to the pressure in the first pressure chamber, against the biasing force and the pressure in the gas storage portion, so that the distal end of the valve element separates from the interface to create the communication between the second flow passage and the third flow passage, wherein the orifice portion includes an orifice configured to discharge, to the first port, gas flowing from the first pressure chamber through the first flow passage and the second flow passage without also flowing through the third flow passage.

2. The gas cylinder according to claim 1, wherein the supply passage includes an internal passage extending along the cylinder chamber inside the cylinder tube, and having one end connected to the second port and another end connected to the gas storage portion.

3. The gas cylinder according to claim 1, wherein a tapered portion that is reduced in diameter from the third flow passage toward the second flow passage is formed in the distal end of the valve element facing the interface.

4. The gas cylinder according to claim 1, wherein the valve element comprises a spool, and the gas storage portion is configured to accommodate the proximal end of the spool.

5. The gas cylinder according to claim 4, wherein the gas storage portion communicates with an outside and is closed by a lid with the elastic element inserted between the lid and the spool.

6. The gas cylinder according to claim 5, wherein:

the first cover is formed with a hole having one end communicating with the second flow passage and another end communicating with the outside;

a sleeve is inserted in the hole;

the spool is slidably placed inside the sleeve; and by closing the hole by the lid, a portion of the hole on a side of the lid forms the gas storage portion, and a portion of the hole on a side of the second flow passage forms the third flow passage.

7. The gas cylinder according to claim 6, wherein a seal member configured to come into sliding contact with an inner circumferential surface of the sleeve is provided on a peripheral surface of the spool.

8. The gas cylinder according to claim 1, wherein the orifice portion and the discharge flow rate regulator are collectively arranged in one side portion with respect to the piston rod inside the first cover.

9. The gas cylinder according to claim 1, wherein the elastic element is a spring member configured to bias the proximal end of the valve element.

10. A gas cylinder, comprising:

a cylinder tube having a cylinder chamber formed therein;

a first cover configured to close one end of the cylinder tube;

a second cover configured to close another end of the cylinder tube;

a piston configured to partition the cylinder chamber into a first pressure chamber on a side of the first cover, and a second pressure chamber on a side of the second cover, and slide in the cylinder chamber;

a piston rod connected to the piston;

a first port through which gas is supplied to and discharged from the first pressure chamber;

a second port through which gas is supplied to and discharged from the second pressure chamber; and a cushioning mechanism configured to brake a motion of the piston at least when the piston stops at a stroke end on the side of the first cover, wherein:

the cushioning mechanism includes a communication shutoff portion configured to shut off communication between the first pressure chamber and the first port when the piston approaches the stroke end, an orifice portion configured to discharge gas from the first pressure chamber, and a discharge flow rate regulator configured to discharge gas from the first pressure chamber in cooperation with the orifice portion;

the discharge flow rate regulator includes:

a discharge flow passage configured to discharge gas in the first pressure chamber, a valve element configured to open and close the discharge flow passage, an elastic element configured to close the discharge flow passage with a distal end of the valve element by directly biasing a proximal end of the valve element to move the valve element, and a gas storage portion;

the valve element is accommodated in the gas storage portion;

the gas cylinder further includes a supply passage configured to supply, to the gas storage portion, a part of gas supplied to the second port;

when a pressure in the first pressure chamber is equal to or lower than a prescribed pressure that is based on a biasing force of the elastic element and a pressure in the gas storage portion, the valve element closes the discharge flow passage by the biasing force and the pressure in the gas storage portion; and when the pressure in the first pressure chamber exceeds the prescribed pressure, the valve element is moved due to the pressure in the first pressure chamber, against the biasing force and the pressure in the gas storage portion, so as to open the discharge flow passage, wherein:

the orifice portion and the discharge flow rate regulator are provided in the first cover, the first port is provided on the first cover, the second port is provided on the second cover, the discharge flow passage is formed of a first flow passage communicating with the first pressure chamber, a second flow passage having an upstream side connected to a downstream side of the first flow passage, a third flow passage having an upstream side connected to a downstream side of the second flow passage and having a larger diameter than the second flow passage, and a fourth flow passage having an upstream side connected to the downstream side of the third flow passage and that communicates with the first port, the valve element has a larger diameter than the second flow passage and the distal end thereof is disposed in the third flow passage, when the pressure in the first pressure chamber is equal to or lower than the prescribed pressure, the valve element is moved to a side of the second flow passage due to the biasing force and the pressure in the gas storage portion so that the distal end of the valve element closes an interface between the second flow passage and the third flow passage to shut off communication between the second flow passage and the third flow passage, and when the pressure in the first pressure chamber exceeds the prescribed pressure, the valve element is moved to a side of the third flow passage due to the pressure in the first pressure chamber, against the biasing force and the pressure in the gas storage portion, so that the distal end of the valve element separates from the interface to create the communication between the second flow passage and the third flow passage, wherein the orifice portion includes an orifice configured to discharge, to the first port, gas flowing from the first pressure chamber through the first flow passage and the second flow passage without also flowing through the third flow passage.

* * * * *